US006860769B2

(12) United States Patent
Liu et al.

(10) Patent No.: US 6,860,769 B2
(45) Date of Patent: Mar. 1, 2005

(54) CATHODE CONTACT PIN FOR AN ELECTROPLATING PROCESS

(75) Inventors: Chung-Shi Liu, Hsin-Chu (TW); Chen-Hua Yu, Hsin-Chu (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 336 days.

(21) Appl. No.: 10/045,417

(22) Filed: Jan. 12, 2002

(65) Prior Publication Data

US 2003/0132102 A1 Jul. 17, 2003

(51) Int. Cl.[7] ..... B05B 5/025

(52) U.S. Cl. ..... 439/887; 118/620; 118/622; 118/624; 118/625

(58) Field of Search ..... 439/887, 886; 118/620, 622, 624, 625

(56) References Cited

U.S. PATENT DOCUMENTS 1,936,469 A * 11/1933 Hill ..... 439/886
3,585,573 A * 6/1971 Robshaw ..... 439/887
5,118,547 A * 6/1992 Chen ..... 428/44
5,140,937 A * 8/1992 Yamane et al. ..... 118/695
5,980,335 A * 11/1999 Barbieri et al. ..... 439/824
6,252,175 B1 * 6/2001 Khandros ..... 174/250
6,534,129 B1 * 3/2003 Miller et al. ..... 427/466
6,538,214 B2 * 3/2003 Khandros ..... 174/267

* cited by examiner

*Primary Examiner*—Gary Paumen
(74) *Attorney, Agent, or Firm*—Tung & Associates

(57) ABSTRACT

A cathode contact pin for making electrically conductive contact with a conductive area for carrying out an electrodeposition process including a stem region disposed adjacent a tip region said stem region for interfacing with an electrical source of power for carrying electrical power to said tip region said tip region having a radius of curvature forming a tip region contact surface for contacting a metal contact pad region such that upon contact a contacting portion of the tip region contact surface is confined within an area defined by the metal contact pad region.

16 Claims, 2 Drawing Sheets

CATHODE CONTACT PIN FOR AN ELECTROPLATING PROCESS

FIELD OF THE INVENTION

This invention generally relates to electroplating cathode contact areas and more particularly to an improved cathode contact pin for making electrical contact with a cathode contact area.

BACKGROUND OF THE INVENTION

In semiconductor fabrication, various layers of insulating material, semiconducting material and conducting material are formed to produce a multilayer semiconductor device. The layers are patterned to create features that taken together, form elements such as transistors, capacitors, and resistors. These elements are then interconnected to achieve a desired electrical function, thereby producing an integrated circuit (IC) device. The formation and patterning of the various device layers are achieved using conventional fabrication techniques, such as oxidation, implantation, deposition, epitaxial growth of silicon, lithography, etching, and planarization.

Sub-micron multi-level metallization is one of the key technologies for the next generation of ultra large scale integration (ULSI). The multilevel interconnects that lie at the heart of this technology require planarization of interconnect features formed in high aspect ratio apertures, including contacts, vias, metal interconnect lines and other features. Reliable formation of these interconnect features is very important to the success of ULSI and to the continued effort to increase circuit density and quality on individual substrates and die.

Copper and copper alloys have become the metal of choice for filling sub-micron, high aspect ratio interconnect features on semiconductor substrates. Copper and its alloys have lower resistivity and higher electromigration resistance compared to other metals such as, for example, aluminum. These characteristics are critical for achieving higher current densities increased device speed.

As circuit densities increase, the widths of vias, contacts, metal interconnect lines, and other features, decrease to sub-micron dimensions, whereas the thickness of the dielectric layers, through the use low-k (low dielectric constant) materials, has remained substantially constant. Consequently, the aspect ratios for the features, i.e., their height divided by width, has increased thereby creating additional challenges in adequately filling the sub-micron features with, for example, copper metal. Many traditional deposition processes such as chemical vapor deposition (CVD) have difficulty filling increasingly high aspect ratio features, for example, where the aspect ratio exceeds 2:1, and particularly where it exceeds 4:1.

As a result of these process limitations, electroplating or electrodeposition, which has previously been limited to the fabrication of patterns on circuit boards, is now emerging as a preferable method for filling metal interconnects structures such as via openings (holes) and trench line openings on semiconductor devices. Typically, electroplating uses a suspension of positively charged ions of deposition material, for example metal ions, in contact with a negatively charged substrate, as a source of electrons, to deposit (plate out) the metal ions onto the charged substrate, for example, a semiconductor wafer. A thin metal layer (seed layer) is first deposited on the semiconductor wafer and in etched features to provide an electrical path across the surfaces. An electrical current is supplied to the seed layer whereby the semiconductor wafer surface is electroplated with an appropriate metal, for example, aluminum or copper.

One exemplary process for forming a series of interconnected multiple layers, for example, is a dual damascene process. Although there are several different manufacturing methods for manufacturing damascene structures, all such methods employ a series of photolithographic masking and etching steps, typically by a reactive ion etch (RIE). In the typical multilayer semiconductor manufacturing process, for example, a dual damascene process, a series insulating layers are deposited to include a series of interconnecting metallization structures such as vias and metal line interconnects to electrically interconnect areas within the multilayer device and contact layers to interconnect the various devices on the chip surface. In most devices, pluralities of vias are separated from one another along the semiconductor wafer and selectively interconnect conductive regions between layers of a multilayer device. Metal interconnect lines (trench lines) typically serve to selectively interconnect conductive regions within a layer of a multilayer device. Vias and trench lines (metal interconnects) are selectively interconnected in order to form the necessary electrical connections. In forming a dual damascene structure, via openings (holes) and trench line openings are anisotropically etched into the insulating layers and are back-filled with metal. The insulating layers where metal interconnect lines (trench lines) are formed are typically referred to as metallization layers and the insulating layer including interconnecting vias are referred to as inter-metal dielectric (IMD) layers. The IMD layers preferably include a low-k (low dielectric constant) insulating material which reduces signal delay times caused by parasitic capacitance. The process by which via openings (holes) and trench lines are selectively etched into the insulating layers is typically a photolithographic masking process, followed by a reactive ion etch (RIE) process, both of which are commonly known in the art.

In filling the via openings and trench line openings with metal, for example, copper, electroplating is a preferable method to achieve superior step coverage of sub-micron etched features. The method generally includes first depositing a barrier layer over the etched opening surfaces, such as via openings and trench line openings, depositing a metal seed layer, preferably copper, over the barrier layer, and then electroplating a metal, again preferably copper, over the seed layer to fill the etched features to form, for example, vias and trench lines. Finally, the deposited layers and the dielectric layers are planarized, for example, by chemical mechanical polishing (CMP), to define a conductive interconnect feature.

Metal electroplating in general is a well-known art and can be achieved by a variety of techniques. Common designs of cells for electroplating a metal on semiconductor wafers involve positioning the plating surface of the semiconductor wafer within an electrolyte solution including an anode with the electrolyte impinging perpendicularly on the plating surface. The plating surface is contacted with an electrical power source forming the cathode of the plating system such that ions in the plating solution deposit on the conductive portion of the plating surface.

One method for providing power to the plating surface uses, for example cathode contacts (e.g., pins, 'fingers', or springs) which contact the plating surface at a cathode contact area which may include a seed layer of metal. The cathode contacts make contact with the cathode contact area which includes a metal layer formed as close as possible to the edge (periphery) of the semiconductor wafer to minimize the wasted area on the wafer due to the cathode contact areas. In order to minimize resistance between the cathode contacts and the cathode contact areas, force is applied to the cathode contacts to assure intimate contact with the seed layer in the cathode contact areas. A shortcoming in the prior art is that, frequently, the electroplating process results in the delamination or peeling of the uppermost insulating (IMD) layers, especially underlying the cathode contact areas, due to the stress induced by the force applied by the cathode contact pins to the metal layer or cathode contact pad. The metal layer or cathode contact pads in the cathode contact areas at the edge of the wafer are typically formed over an uppermost insulating (IMD) layer devoid of etched semiconductor features such as vias and trench lines. However, co-pending application Ser. No. 10/316,677, which is incorporated herein by reference in its entirety, provides a method for strengthening the underlying insulating layer to resist delamination or cracking caused by the cathode contact pins by forming metal interconnects in the insulating layer in the cathode contact area.

The delamination and cracking problem is, however, exacerbated by the use of low-k (low dielectric) material in insulating (IMD) layers, for example, carbon doped silicon dioxide. In order to reduce signal delays caused by parasitic effects related to the capacitance of insulating layers, for example, IMD layers, incorporation of low-k materials have become standard practice as semiconductor feature sizes have diminished. Many of the low-k materials are designed with a high degree of porosity to allow the achievement of lower dielectric constants. One consequence of using porous low-k materials in insulating layers is that the insulating layers have reduced strength and are prone to delamination (peeling) and cracking when they are subjected to processing stresses, for example, stresses induced by the forces applied by electroplating cathode contacts.

FIG. 1A, shows for example, a side view of a cathode contact pin 10 according to the prior art for making contact with the metal seed layer or cathode contact pad in a cathode contact area. According to the prior art, the tip region 12 of the cathode contact pin 10 typically has an angled surface forming an angle theta 14 at the pointed tip 16, designed to slightly penetrate the cathode contact pad to provide a low resistance contact. For example, as shown in a top view of the tip region 12 in FIG. 1B, the tip region 12 of the cathode contact pin 10 may include faceted surfaces 18 that form a pyramidal shape that, for example, includes four angled surfaces forming pointed tip 16 for slightly penetrating a metal surface. A shortcoming of the pointed tip cathode contact pin according to the prior art is that the force applied by the cathode contact pin is distributed over a small area of the cathode contact surface resulting in a force per unit area that is incompatible with current semiconductor processing technologies.

As such, metal seed layers or cathode contact pads including relatively ductile copper or copper alloy, are easily penetrated and disturbed, causing the applied forces to be further concentrated on the underlying insulating layer. Consequently, newer low-k materials used for the insulating layers, which are frequently porous, are not able to withstand applied forces typically applied with a pointed tip design cathode contact pin. As a result, delamination and cracking of the insulating layer may accompany the electroplating process or occur is subsequent semiconductor wafer processing steps resulting in lower semiconductor wafer yields. Further, as the trend in semiconductor device manufacturing is to increase the number of layers in a multilayer device structure, the problem is further exacerbated by the additive buildup of stresses as more layers are included in multilayer structures.

There is therefore a need in the semiconductor processing art to develop an improved electroplating cathode contact pin that is compatible with current semiconductor manufacturing technologies whereby forces are better distributed to avoiding delamination or cracking of the insulating layers while achieving low resistance electrical contact with cathode contact areas.

It is therefore an object of the invention to provide an improved electroplating cathode contact pin that is compatible with current semiconductor manufacturing technologies whereby forces applied by the cathode contact pin are better distributed thereby avoiding delamination or cracking of the insulating layers while achieving low resistance electrical contact with cathode contact areas in addition to overcoming other shortcomings and deficiencies in the prior art.

SUMMARY OF THE INVENTION

To achieve the foregoing and other objects, and in accordance with the purposes of the present invention, as embodied and broadly described herein, the present invention provides a cathode contact pin for making electrically conductive contact with a conductive area for carrying out an electrodeposition process In a first embodiment of the present invention, the cathode contact pin includes a stem region disposed adjacent a tip region said stem region for interfacing with an electrical source of power for carrying electrical power to said tip region said tip region having a radius of curvature forming a tip region contact surface for contacting a metal contact pad region such that upon contact a contacting portion of the tip region contact surface is confined within an area defined by the metal contact pad region.

In related embodiments, the stem region cross section comprises a round or polygonal shape. Further, the stem region has an outer diameter that is within a range from about one half a tip region radius to about four times a tip region radius. Further yet, a tapered transition region connects the stem region to the tip region. Further yet, the radius of curvature along a tip region contact surface varies to form an ellipsoid shape. Further yet, the metal contact pad region includes a rectangular area from about 50 microns to about 200 microns on a side. Further yet, the stem region and tip region include at least one of aluminum, copper, palladium, nickel, gold, silver, rhodium and iridium.

In other related embodiments, the metal contact pad region comprises a metal layer overlying at least an insulating layer. Further yet, the at least an insulating layer includes a plurality of metal filled openings including at least one of vias and trench lines. Further yet, the metal layer and the plurality of metal filled openings include copper or an alloy thereof.

These and other embodiments, aspects and features of the invention will be better understood from a detailed description of the preferred embodiments of the invention which are further described below in conjunction with the accompanying Figures.

DETAILED DESCRIPTION OF THE PREFERRED EMBODIMENTS

The method and apparatus according to the present invention is more clearly described by referring to FIGS. 1A–1B, FIGS. 2A and 2B, FIG. 3, and FIGS. 4A–4C.

Figure 1A:
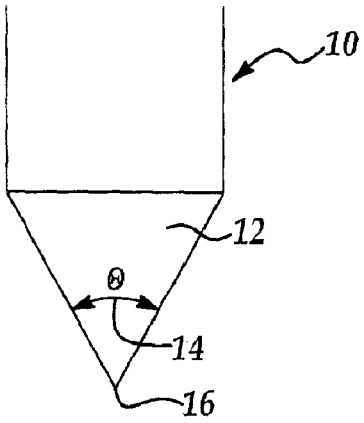
Figure 1A Prior Art
FIGS. 1A–1B depict a side view and a top view, respectively, of a cathode contact pin according to the prior art.
Figure 1B:
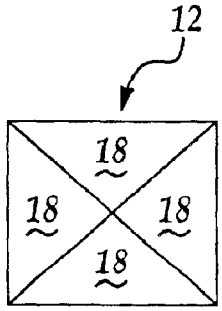
Figure 1B Prior Art
Figure 2A:
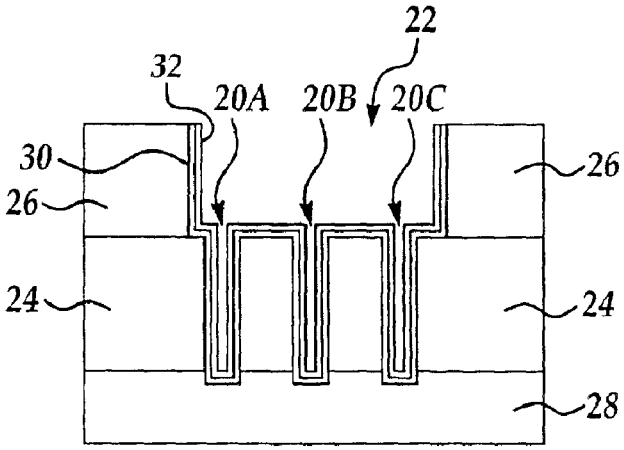
FIG. 2A is a cross sectional side view representation of a typical dual damascene structure at a stage of production in a semiconductor manufacturing process.

FIG. 2A, depicts a cross-sectional representation of a portion of a typical dual damascene structure. Although FIG. 2A shows a portion of a typical dual damascene structure, it is understood that such structures may be repeated in spaced relationship across a portion of a semiconductor wafer and repeated in multiple layers to create a multilayer active device area. Further, the semiconductor wafer may consist of several active device areas forming individual chips located in a central portion of the wafer.

Referring to FIG. 2A, in a typical dual damascene structure via openings 20A, 20B, 20C and trench line opening 22 are formed in an intermetal dielectric (IMD) layer 24 and metallization layer 26, respectively. Typically, trench line openings overlie one or more via openings. Both the IMD layer 24 including the via openings 20A, 20B, 20C, and the metallization layer 26 including the trench line opening 22 are preferably formed of a low-k (low dielectric constant material), for example, carbon doped silicon dioxide, with a dielectric constant of less than about 3.0. The IMD layer 24 and the metallization layer 26 are typically formed by conventional CVD processes including PECVD , with the IMD layer 24 typically about 8000 Angstroms in thickness and the metallization layer typically about 5000 Angstroms in thickness. The via openings 20A, 20B, 20C, and trench line opening 22 are typically formed by two photolithographic patterning and reactive ion etch (RIE) steps. After forming via openings and trench line openings by etching, via openings 20A, 20B, 20C and trench line opening 22 are back filled with a metal, for example, copper, to form conductive interconnects that will provide an electrical connection with, for example, the underlying conductive feature 28.

Between (IMD) layer 24 and metallization layer 26, there are typically formed an etch stop layer (not shown), preferably silicon nitride (SiN), and a dielectric antireflective coating (DARC) layer (not shown), preferably silicon oxynitride (SiON), for reducing undesirable light reflections in the photoresist masking process to define, for example, via openings.

Prior to filling the via openings 20A, 20B, 20C, and trench line opening 22 with, for example, copper, typically a barrier layer 30 of, for example, tantalum or tantalum nitride (TaN) is substantially conformally deposited over the via openings and trench line opening to cover the via floor, via walls, and trench walls. The barrier layer is formed to prevent diffusion of the fill metal, for example, copper, into the insulating IMD layer 24 and metallization layer 26. The barrier layer is preferably formed of tantalum or tantalum nitride, however other barrier layers such as titanium, titanium nitride and combinations thereof may also be used. In addition, the barrier layer may be silicided by a conventional process. The deposition process used may be PVD, CVD, or PECVD, such processes being well known in the art. The barrier layer typically has a thickness between about 25 Angstrom and about 400 Angstroms.

Prior to performing an electroplating process to fill the via opening 20A, 20B, 20C, and trench line opening 12 with a metal, for example, copper, a seed layer 32, of for example copper, is deposited over the barrier layer 30. Other metals, particularly noble metals, may also be suitably used for the seed layer. The seed layer 32 provides good adhesion for subsequently electrodeposited metal layers, as well as a substantially conformal layer for substantially conformal plating of the electrodeposited metal layer thereover. The seed layer 32 is deposited over the active areas included in a semiconductor wafer and provides an electrically conductive layer for a cathodic reaction in an electroplating process where metal ions in an electroplating solution are deposited out of solution onto the copper seed layer 32. The seed layer 32 may be formed by a conventional CVD or physical vapor deposition (PVD) process. The thickness of the seed layer 32 varies between about 1000 angstroms and 4000 angstroms depending upon varying process constraints (contact aspect ratio and thermal constraints) and IC product types.

A metal layer, preferably copper (not shown) is electroplated over the seed layer 32 to completely fill the via openings 20A, 20B, 20C and trench line opening 22. Following the electroplating process, the exposed metal is then planarized, preferably by chemical mechanical polishing (CMP). During the planarization process, portions of the metal layer (not shown), seed layer 32, barrier layer 30, and dielectric layer 26 are removed from the upper surface of the structure, leaving a fully planar surface including vias and trench lines.

In performing the electroplating process, power to the semiconductor wafer plating surface is supplied by cathode contacts (e.g., pins, 'fingers', or springs) which contact metal contact pad regions, for example copper, overlying cathode contact areas located at the periphery region of the semiconductor wafer. The metal contact pad regions are located as close as practically possible to the edge of the semiconductor wafer to minimize the wasted area on the wafer due to the presence of the cathode contact areas.

One method for forming cathode contact areas with increased strength thereby resisting delamination and cracking is outlined in co-pending application Ser. No. 10/316,677. The cathode contact areas include vias and/or trench lines formed in an insulating (IMD) layer underlying the metal contact pad region. The metal contact pad region and the vias and/or trench line preferably include copper or an alloy thereof. While the invention is explained with reference to cathode contact areas including underlying vias and trench lines, it will be appreciated that the cathode contact pin of the present invention may be advantageously applied to cathode contact areas devoid of vias and/or trench lines, including a metal contact pad region overlying an insulating layer. In this regard, the metal contact pad region is formed so that it is in electrical communication with the metal seed layer formed over the active device features disposed in the central portion of the semiconductor as further explained below with reference to FIG. 4A.

Figure 2B:
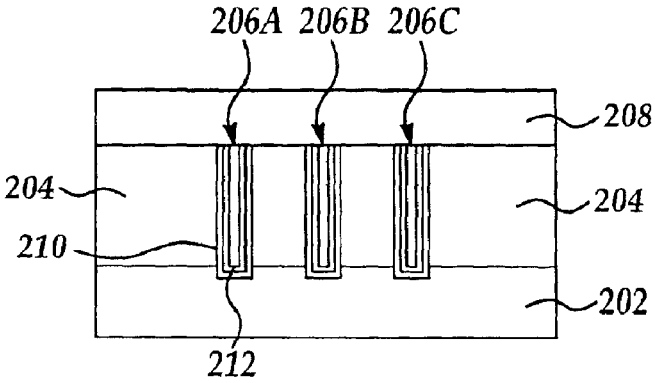
FIG. 2B is a cross sectional side view representation of an exemplary cathode contact area according to the present invention.

Referring to FIG. 2B, is an enlarged cross-section of a portion of an exemplary cathode contact area as outlined in co-pending application Ser. No. 10/316,677. Conductive layer region 202, for example copper, underlies an insulating (IMD) layer 204, in which vias and/or trench lines (metal interconnects) 206A, 206B, 206C, are formed within the insulating layer 204. The metal interconnects e.g., 206A,

206B, 206C (cathode contact area etched openings) may be either vias or trench lines. Preferably, the etched openings are formed in a single layer damascene structure as opposed to a dual damascene structure.

Further, the insulating layer 204 is preferably formed with a low-k dielectric having a dielectric constant of less than about 3.0, and is formed by conventional CVD deposition processes including PECVD or HDPCVD. A barrier layer 210 is preferably substantially conformally deposited over the metal interconnects e.g., 206A, 206B, 206C, The barrier layer may be a thin layer, typically 15 Angstroms to 50 Angstroms in thickness, of tantalum nitride, titanium nitride, or silicided versions thereof.

The metal interconnects e.g., 206A, 206B, 206C, may be filled with conventional PVD, CVD or metal flow processes, or may be filled by a conventional electrodeposition process. If an electrodeposition process is used, a seed layer 212, for example, copper or an alloy thereof, is conformally formed over the barrier layer 210.

Following the metal filling of the metal interconnects e.g., 206A, 206B, 206C, the cathode contact area is planarized according to a conventional CMP process, leaving a fully planar surface with metal interconnects including vias and/or trench lines (cathode contact area metal interconnects).

Following planarization, metal contact pad regions e.g., 208, for example copper or an alloy thereof, are formed over the cathode contact areas by conventional photolithographic masking, etching, and PVD or CVD processes, or may be formed by an electrodeposition process. The metal contact pad regions 208 are preferably deposited with a thickness ranging from about 1000 Angstroms to about 4000 Angstroms.

Figure 3:
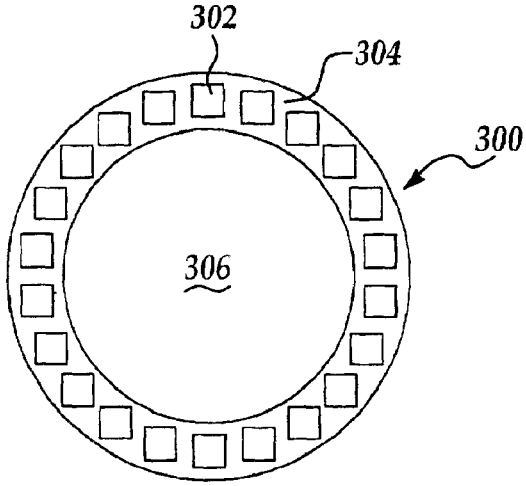
FIG. 3 is a top view of a semiconductor wafer with exemplary metal contact pad regions according to the present invention.

As explained in co-pending application Ser. No. 10/316,677, the cathode contact areas preferably include a plurality of metal contact pad regions surrounding the periphery of the semiconductor wafer. The metal contact pad regions are preferably a rectangular area of about 50 to 150 microns on a side and more preferably a 100 micron by 100 micron square area. Referring to FIG. 3, exemplary metal contact pad regions e.g., are shown surrounding a periphery portion 304 of a semiconductor wafer 300. Inside the periphery portion 304 of the semiconductor wafer is a central portion 306 including active device areas. Preferably the metal contact pad regions e.g., 302 are located at the periphery portion 304 of the semiconductor wafer 300 to include the entire circumference of the semiconductor wafer 300. While the metal contact pad regions are exemplary only and presented to clarify the present invention, it will be understood however, that the present invention including an improved cathode contact pin may be advantageously applied to any shaped metal contact pad region including, for example, one or more continuous ring shaped areas as the periphery of the semiconductor wafer. In an exemplary operation, the cathode contact pins are attached to a cathode contact substrate which is electrically connected to the cathode power source of an electroplating system. The cathode contact substrate including the cathode contact pins is positioned adjacent the semiconductor wafer to make contact with the metal contact pad regions 302 overlying the cathode contact areas.

Figure 4A:
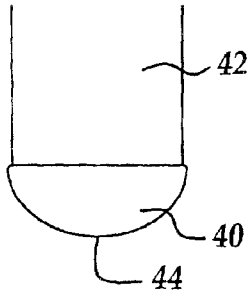
FIGS. 4A–4C are side view representations of exemplary cathode contact pins according to the present invention.

Turning to FIG. 4A, according to the present invention, is shown an improved cathode contact pin for making contact with the metal contact pad regions overlying the cathode contact area. As shown in FIG. 4A, the cathode contact pin includes a tip region 40 connected to a stem region 42. The tip region includes a radius of curvature 44 forming a convex surface for contacting a metal contact pad region or seed layer. In one embodiment, the radius of curvature is preferably in a range of about one half the radius of the stem region of the cathode contact pin to about twice the radius of the stem region cathode contact pin. The radius of curvature may stay constant to form a spherical or hemispherical shape or may vary along the convex surface (contact surface) to form an ellipsoid shape. In another embodiment, the radius of curvature of the tip of the cathode contact pin may be within a range of about 20 microns to about 200 microns. Preferably, that portion of the radius of curvature of the tip region making contact with the metal contact pad region forming a tip region contact surface is no larger than the metal contact pad region, for example, a square of about 100 microns by about 100 microns. More preferably, more than one cathode contact pin tip makes contact with a single metal contact pad region (contact pad) in order to better distribute the applied forces. An exemplary size of the cathode contact pin stem region may be about 100 microns to about 800 microns in overall height, and about 60 to about 400 microns in diameter.

Figure 4B:
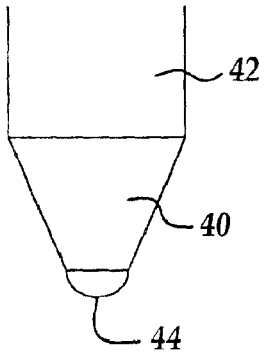
Figure 4C:
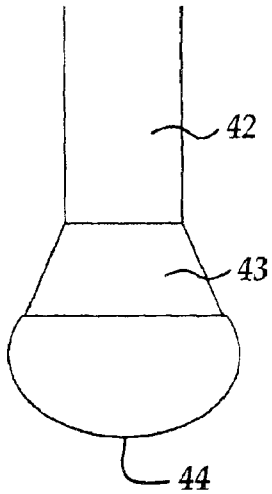

Referring to other exemplary embodiments of the cathode contact pin according to the present invention, in FIG. 4B the stem region 42 of the contact pin may have a larger diameter compared to the tip region 40 for increased strength and may be tapered down from the stem region 42 to about the diameter of the tip region 40 along a tapered stem transition region 43 adjacent the tip region 40. In another exemplary embodiment, referring to FIG. 4C, the stem region 42 of the contact pin may have a smaller diameter than the tip region 40 and may be tapered out from the stem region 42 along a tapered stem transition region 43 to about the diameter of the tip region 40 adjacent the tip region 40. In this embodiment, the forces applied to the stem region 42 are better distributed over the radius of curvature 44. It will be appreciated that the range of sizes may vary and is dependent on the application of the present invention.

The cathode contact pin preferably includes an alloy with good electrical conducting properties and good strength and stiffness such as noble metal alloys, copper or copper alloys, such as copper-palladium (Cu—Pd), nickel or nickel alloys such as nickel palladium (Ni—Pd), nickel gold (Ni—Au), aluminum or aluminum alloys, rhodium (Rh), and iridium (Ir). Preferably, at least the tip of the cathode contact pin includes a coating of an oxidation resistant metal such as gold (Au), platinum (Pt), silver (Ag), nickel palladium (Ni—Pd), rhodium (Rh), nickel gold (Ni—Au), or iridium (Ir).

The cathode contact pins may be made by conventional production processes on, for example a silicon substrate. Such semiconductor production processes includes photolithography, a micro-machining using, for example, an electron beam, laser beam or plasma beam micromachining tool, a plastic molding process (hot embossing), and the like. The cathode contact pin tip region may be coated with conventional processes such as vacuum evaporation, cathode sputtering, and vapor-phase deposition.

One exemplary semiconductor production process is, for example is a silicon-on-insulator (SOI) method in which a silicon layer is mounted on an insulation layer of another silicon layer (substrate). Following a series of photolithography and etching steps, for example, by either wet etching or plasma etching, the cathode contact pin shape including a tip region having a radius of curvature is formed. The etched shape is may then be filled with an electroplating process or conventional deposition methods such as vacuum evaporation, cathode sputtering, and vapor-phase deposition.

Another exemplary production process includes using a plastic molding (hot embossing) method where a mold insert representing the desired shape is first micro-machined by a variety processes including excimer laser ablation, electro-discharge machining, and laser cutting, followed by hot-pressing the mold insert into a thermoplastic resin thereby forming a mold shape. The mold may then be filled by electroplating following deposition of a seed layer or may be filled by conventional physical vapor deposition (PVD) or chemical vapor deposition (CVD) methods.

According to the present invention, the cathode contact pin with a tip region including a radius of curvature distributes the applied contact force over a greater area, thus reducing the force per unit area applied to the cathode contact area. As a result, stresses induced in the insulating layer underlying the cathode contact pad (metal contact pad region) are reduced thereby reducing the incidence of delamination or peeling and cracking of the underlying insulating layer during or following the electroplating process.

The preferred embodiments, aspects, and features of the invention having been described, it will be apparent to those skilled in the art that numerous variations, modifications, and substitutions may be made without departing from the spirit of the invention as disclosed and further claimed below.

What is claimed is:

1. A cathode contact pin for making electrically conductive contact with a conductive area for carrying out an electrodeposition process comprising:

a stem region disposed adjacent a tip region said stem region for interfacing with an electrical source of power for carrying electrical power to said tip region said tip region having a radius of curvature forming a tip region contact surface for contacting a metal contact pad region such that upon contact a contacting portion of the tip region contact surface is confined within an area defined by the metal contact pad region, said radius of curvature alone said tip region contact surface varies to form an ellipsoid shape.

2. The cathode contact pin of claim 1, wherein the stem region cross section comprises a round or polygonal shape.

3. The cathode contact pin of claim 1, wherein the stem region has an outer diameter that is within a range from about one half a tip region radius to about four times a tip region radius.

4. The cathode contact pin of claim 1, wherein the metal contact pad region includes a rectangular area from about 50 microns to about 200 microns on a side.

5. The cathode contact pin of claim 1, wherein the stem region and tip region include at least one of aluminum, copper, palladium, nickel, gold, silver, rhodium and iridium.

6. The cathode contact pin of claim 1, wherein the metal contact pad region comprises a metal layer overlying at least an insulating layer.

7. The cathode contact pin of claim 5, wherein the at least an insulating layer includes a plurality of metal filled openings including at least one of vias and trench lines.

8. The cathode contact pin of claim 6, wherein the metal layer and the plurality of metal filled openings include copper or an alloy thereof.

9. A cathode contact pin for making electrically conductive contact with a conductive area on a semiconductor wafer surface for carrying out an electrodeposition process comprising:

a stem region adjacent a tip region said stem region for interfacing with an electrical source of power for carrying electrical power to said tip region said tip region having a radius of curvature forming a tip region contact surface for contacting a metal contact pad region disposed at the periphery of a semiconductor wafer said metal contact pad region including a metal layer overlying at least an insulating layer, said radius of curvature along said tip region contact surface varies to form an ellipsoid shape.

10. The cathode contact pin of claim 9, wherein the stem region adjacent the tip region has an outer diameter that is within a range from about one half a tip region radius to about four times a tip region radius.

11. The cathode contact pin of claim 9, wherein the stem region cross section comprises at least one of a round or polygonal shape.

12. The cathode contact pin of claim 9, wherein the tip region has a radius of from about 50 microns to about 200 microns.

13. The cathode contact pin of claim 9, wherein the stem region and tip region include at least one of aluminum, copper, palladium, nickel, gold, silver, rhodium and iridium.

14. The cathode contact pin of claim 9, wherein the metal contact pad region is in electrical communication with a central portion of a semiconductor wafer including a metal seed layer.

15. The cathode contact pin of claim 9, wherein the at least an insulating layer includes a plurality of metal filled openings including at least one of vias and trench lines.

16. The cathode contact pin of claim 9, wherein the at least an insulating layer comprises a material with a dielectric constant of at most about 3.0.

* * * * *